United States Patent [19]

Whinfrey

[11] Patent Number: 4,516,728

[45] Date of Patent: May 14, 1985

[54] LIQUID FUEL ATOMIZER

[75] Inventor: Dennis R. Whinfrey, Derby, England

[73] Assignee: Northern Engineering Industries plc, England

[21] Appl. No.: 472,041

[22] Filed: Mar. 4, 1983

[30] Foreign Application Priority Data

Mar. 26, 1982 [GB] United Kingdom ..... 8208898

[51] Int. Cl.[3] ..... B05B 7/00

[52] U.S. Cl. ..... 239/399; 239/433

[58] Field of Search ..... 239/433, 427.3, 399, 239/468, 403, 424, 430

[56] References Cited

U.S. PATENT DOCUMENTS

| | | | |
|---|---|---|---|
| 918,916 | 4/1909 | Ruggles | 239/399 |
| 2,514,581 | 7/1950 | Janssen | 239/399 |

FOREIGN PATENT DOCUMENTS

| | | | |
|---|---|---|---|
| 229404 | 1/1910 | Fed. Rep. of Germany | 239/399 |
| 1424191 | 2/1975 | United Kingdom . | |
| 2117274 | 10/1983 | United Kingdom | 239/433 |

*Primary Examiner*—Andres Kashnikow
*Assistant Examiner*—James R. Moon, Jr.

[57] ABSTRACT

An atomizer in which oil is atomized by steam and a hollow conical pattern of oil is emitted for combustion and applicable to boiler firing. Oil and steam flows pass through intersecting passages so that atomization occurs before the oil and steam mixture enters an annular chamber; or the flows intersect at or adjacent entry to the chamber. Further mixing occurs in the chamber from which the mixture is emitted.

10 Claims, 2 Drawing Figures

LIQUID FUEL ATOMIZER

BACKGROUND OF THE INVENTION

The invention relates to liquid fuel atomisers.

An atomiser has been proposed in British Patent Specification No. 1424191 (The Secretary of State for Defence) in which an annular outlet receives streams of oil and atomising steam directed in intersecting directions.

An atomiser has been proposed in British patent specification No. 1470671 (CEGB) in which an annular duct receives oil to be atomised from which duct the oil passes to individual nozzle outlets each receiving a respective stream of atomising steam U.S. Pat. No. 2,868,587 (Hegmann) describes a comminuting nozzle in which an annular chamber receives air supplies in intersecting directions.

No use in actual oil burning installations has apparently been made of such atomisers or comminuting nozzles.

The Applicant has found by actual experimental trial in an actual working power installation boiler furnace that very efficient atomisation can be achieved by introducing steam and oil into an annular chamber and causing them to rotate in the chamber.

BRIEF SUMMARY OF THE INVENTION

An object of the invention is to provide a liquid fuel atomiser in which the fuel is atomised by an atomising fluid and which the fluids are fed to an annular chamber in which they rotate.

The invention is particularly, though not exclusively, applicable to atomisers for oil burners for use in firing large water tube boilers using steam as atomising medium.

An atomiser, according to the invention, comprises a body defining an internal annular chamber, said body having exit formations and having annularly distributed internal passages through which flows of fuel medium and atomising medium pass, the directions of said passages for one medium and the directions of respective passages for the other medium making intersections one with the other, said body defining openings by which said media enter said chamber at positions which are such as to produce rotation of media therein and which are closer than said formations to said intersections, and said media leaving said chamber by way of said exit formations to be directed thereby into a hollow diverging frusto-conical pattern.

BRIEF DESCRIPTION OF THE DRAWINGS

Atomisers will now be described by way of example with reference to the accompanying drawings in which.

DETAILED DESCRIPTION OF THE PREFERRED EMBODIMENTS

Figure 1:
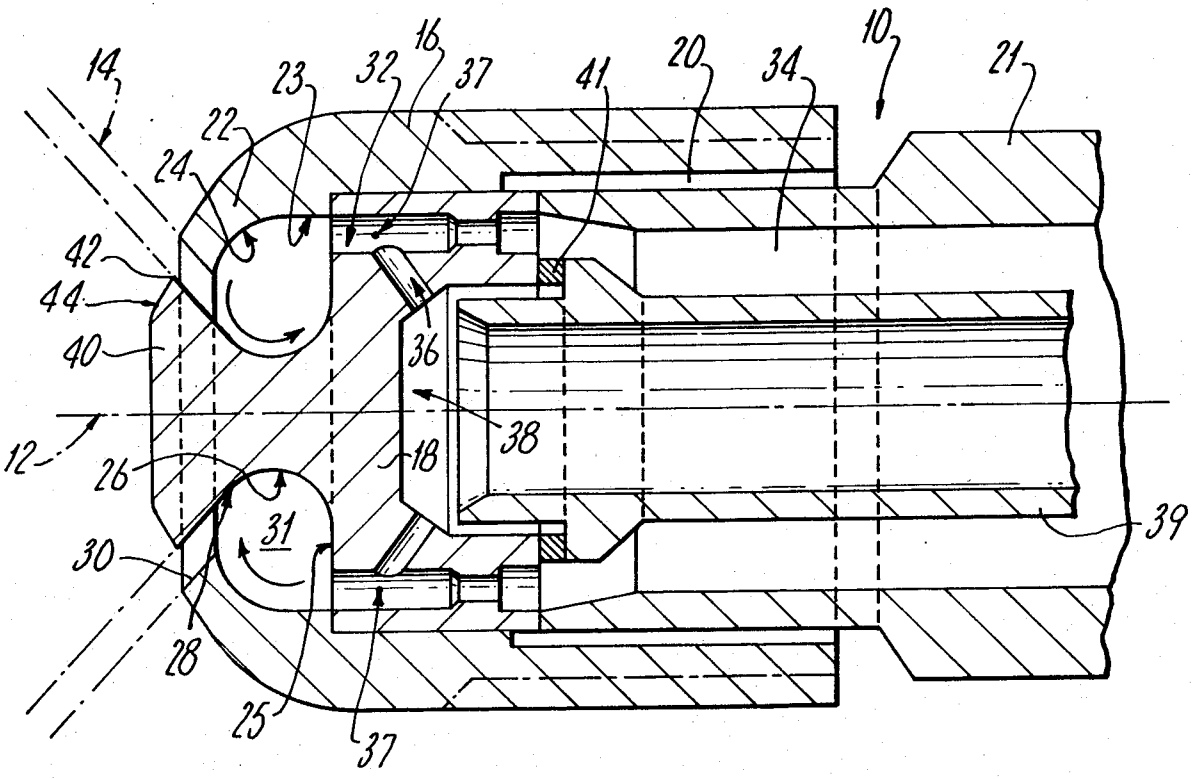
FIGS. 1 and 2 are longitudinal sections through parts of two different forms of atomiser.

The atomiser shown in FIG. 1 comprises an elongate body 10, only the forward end being shown which is intended for use as part of an oil burner for a water tube boiler. In such burners oil is atomised and dispersed by the atomiser which is centrally positioned in the burner assembly (not shown). The atomiser has a central longitudinal axis indicated at 12 and the atomised oil is dispersed in a hollow diverging frusto-conical pattern indicated partly at 14. The burner assembly supplies combustion air to the dispersed oil which burns to produce a suspended flame.

The atomiser comprises a body made up of a hollow outer part in the form of a cap nut 16 and an inner, partly hollow part 18. The rear end of the outer part 16 is internally screw-threaded at 20 so that it can be screwed onto a rear hollow body part 21 of the atomiser.

The outer part 16 has an inwardly directed annular flange 22 at its forward end.

The outer part 16 has an internal cylindrical surface at 23.

The flange 22 has an inner surface 24 which is of double curvature, which merges smoothly with the cylindrical surface 23. The first curvature of large radius is concentric with the axis 12. The surface 24 has a second curvature transverse to the first curvature and of smaller radius than that of the first curvature. The second curvature is fully shown in the drawing. The inner part 18 has an annular external groove which is bounded by a plain annular surface 25 normal to the axis 12, by an annular surface 26 which merges smoothly with the surface 25 and by an annular surface 28, which merges smoothly with the surface 26. The surface 26 is of double curvature and has a first curvature of larger radius concentric with the axis 12 and a second curvature less than, and transverse to, the first, as clearly shown in the drawing. The surfaces 24, 25 and 26 are coaxial with the axis 12.

The surface 28 is frusto-conical. There is a co-axial frusto-conical surface 30 at the inner edge of the flange 22 coaxial with the surface 28.

The surfaces 23, 24, 25 and 26 enclose an annular, ring-like chamber 31. A number of cylindrical feed passages 32 through the inner part 18 (for example eight or eighteen) which are equiangularly distributed about the axis 12 open into the chamber 31 at the surface 25, their function being to feed oil and atomising steam into the chamber 31.

Each passage 32 extends parallel to the axis 12 and communicates with an annular space 34 through which steam at a pressure of around 100 pounds per square inch for example is supplied to the passage 32. The steam is typically at 180° to 300° Centigrade.

The passages 32 are in communication with respective inclined feed passages 36 through the inner part 18. Each passage 36 leads from an oil supply space 38 in the inner part 18, and opens into the passage 32. The directions of the passages make intersections 37 one with the other in the respective passage 32, in each case. The flows of steam and oil enter the chamber 31 at the positions where the passages 32 open into the chamber 31. Those positions are closer than the formations 28, 30 to the intersections 37. Oil, at a pressure of 152 p.s.i. for example and at a temperature of 130° C. is supplied through an inner supply tube 39 to the space 38 and thence to the passages 36 into the passages 32.

The tube 39 engages a ring-seal 41 engaging the inner part 18.

The leading end of the inner part 18 is frusto-conical spray plate 40 which, if preferred, may be made as a separate piece secured to the remainder of the part 18. The spray plate 40 has a sharp, circular, peripheral edge 42 at which the frusto-conical surface 28 and a frusto-conical surface 44 meet. The intersections as shown between the plane of the drawing and those two surfaces 28 and 44 are at right angles. There is no chamfer or radiussed edge surface at the edge 42.

OPERATION

Each feed passage 32 conducts a flow of steam from the space 34 to the chamber 31 and conducts a flow of oil from the space 38 to the chamber 31.

The oil flows enter the respective feed passages 32 in inclined directions each dictated by the angle of inclination of the respective passage 36. The directions of flow of steam and oil intersect in the feed passages 32 so that in each feed passage 32 there is an interaction between steam and oil, as the result of which steam and oil are mixed for the first time, one with the other, in the passages 32 before entering the chamber 31 and commencing rotation. However, there is a probability that unsufficiently atomised oil enters the chamber 31.

Both the oil and the steam contribute energy to the oil and steam in the chamber 31. The passages 32 are directed parallel to the adjacent annular cylindrical surfaces 23, offset from the centres of curvature of the surfaces 24, 25 and 26 so that the energy of the incoming oil and steam imparts rotation to oil and steam in the chamber 31. The rotation throughout the chamber is in the sense indicated by the arrows in the drawing. The rotation is transverse to the general plane of the chamber 31, which plane is transverse to the axis 12.

The rotation of oil and steam in the chamber 31 gives an opportunity for further mixing of the oil and steam and for a greater proportion of oil to be properly atomised.

The energy of the steam is the principal factor contributing to the atomisation of the oil and to its expulsion from the chamber 31 through the annular gap between the end formations on the outer part 16 and the inner part 18 which provide the two frusto-conical surfaces 30 and 28, respectively. Those formations direct the expelled oil into the hollow diverging frusto-conical pattern 14. Typically, for example, the gap between the surfaces 28 and 30 may be 3 millimeters (0.118 inch). The radius of curvature of the surface 23 is typically 20 mm (0.90 inch); the lesser radius of curvature of the surface 24 (i.e. the radius of the curvature shown in the drawing) is typically 7 mm (0.295 inch); and the lesser radius of curvature similarly of the surface 26 as shown is typically 6 mm (0.236 inch).

The median major diameter of the annular chamber 31 measured between the approximate centres of the upper and lower sections of the chamber shown in the drawing is typically 23.5 mm (0.925 inch).

The angle between the axis 12 and the intersection of either the surface 28 or 30 and the plane of the drawing is 50° typically.

In a modification (not shown) the passages 32 may all be inclined in a common sense relatively to the plane of the drawing so as to give a skewed arrangement of passages. That causes the oil and steam in the chamber 31 to rotate not only as described above but to rotate also about the axis 12.

Figure 2:
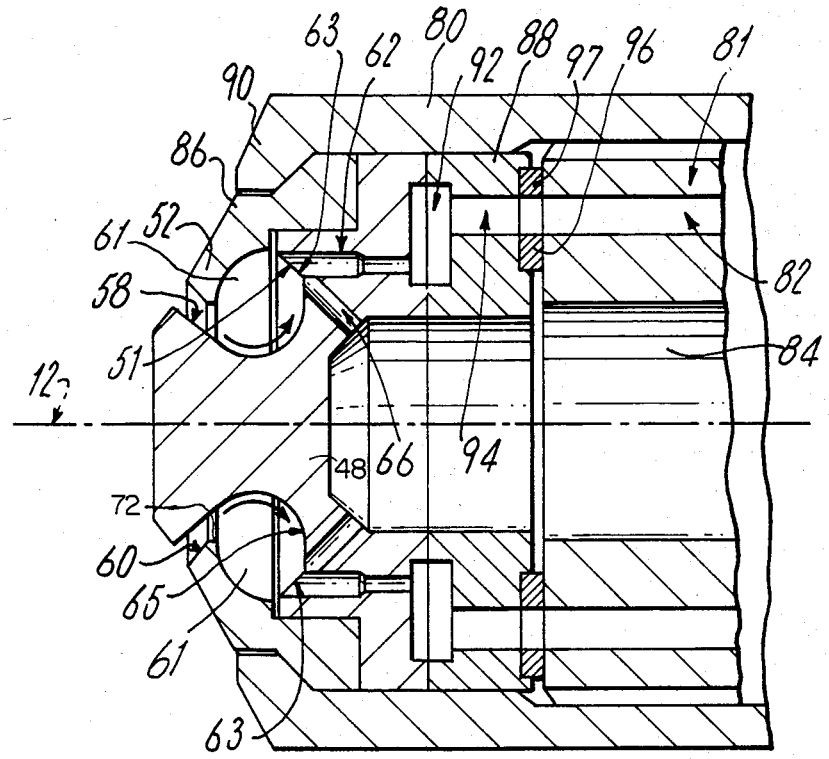

In the modification shown in FIG. 2, the inner part 48 corresponding to the part 18 in FIG. 1 is modified so that the steam feed passages 62 open into the chamber 61 at a frusto-conical surface 51 instead of the plain surface 21. Furthermore, the oil feed passages 66 open partly into the steam passages 62 and partly into the chamber 61 at an annular plain face 65 immediately radially inwardly of the surface 51. The inclinations of the surface 51 and the oil passages 66 to the axis 12 are the same (in this example 45°).

Those positions are closer than the formations 58 and 60 (corresponding to the formations 28 and 30 in FIG. 1) to the intersections 63. The directions of the passages make intersections 63 with one another, in each case, at the position at which the respective passage 62 opens into the chamber 61.

The part 48 fits inside an outer nut 80 which is screwed onto the forward end of a generally tubular assembly 81 not shown in detail but including steam passages 82 and an inner oil passage 84.

The part 48 is trapped between a forward ring 86, which provides a flange 52 corresponding to the flange 22 (FIG. 1), and an annular mild steel backplate 88. The ring 86 is retained by an inwardly-directed flange 90 on the nut 80.

The part 48 and the back plate 88 have opposed annular recesses forming an annular steam distribution gallery 92. The engaging surfaces of the part 18 and the backplate 88 are lapped. The steam passages 82 communicate with the gallery through apertures 94 in the backplate 88 and through inner and outer annealed copper seal rings 96, 97, respectively positioned in an annular recess in the backplate 88 and abutting the tubular assembly 81. The entrances to the apertures 94 lie between the inner and outer seal rings 96, 97, respectively.

The peripheral inner edge 72 of the ring 86 is a narrow cylindrical surface instead of a sharp edge.

The part 18 and the ring 86 are of hardened and tempered KE 970 tool steel.

The surfaces 58 and 60 (corresponding to the surfaces 28 and 30 in FIG. 1) are slightly divergent outwardly, to define a divergent gap therebetween.

The operation of the atomiser shown in FIG. 2 is generally similar to that of the example described with reference to FIG. 1. The direction of flow of oil in each steam feed passage 62 and the direction of flow of oil in each respective oil feed passage 66 intersect each other. The interactions between the flows of steam and oil through the feed passages occur at the openings of the two feed passages in each case and cause steam and oil to mix for the first time, one with the other. A hollow outwardly diverging frusto-conical pattern of atomised oil is produced by the expulsion of oil and steam through the annular gap between the formations 58 and 60.

In modifications (not shown) the oil feed passages may be positioned slightly further forward than shown in FIG. 2 so that they open only into the chamber 61 and not into the steam feed passages 62. In such modifications the directions of the passages, in each case, make intersections one with another in the chamber 61 adjacent the positions at which the passages 62 and 66 open into the chamber 61. Thus, the two media intersect in each case to give interactions between the flows which in each case are adjacent both of the positions at which the steam and oil feed passages open into the chamber 61.

The interactions cause the steam and oil newly introduced into the chamber 61 to mix the first time, one with the other.

Both the steam and the oil flows are such as to produce rotation of media in the chamber 61, as before.

In both of the forms of atomiser described with reference to FIGS. 1 and 2 the directions in which fuel leaves the chamber are eccentric to the circulation in the chamber and so are the feed passages 32 or 62 and 66. Recirculating media, after passing the positions at which the media enter the chamber 31 (i.e. the positions at which the passages 32 or the passages 62 and 66 open into the chamber 31), flows in annularly convergent mode towards the axis 12.

After passing the annular exit gap between the formations 58 and 60 the recirculating media flow in annularly convergent mode substantially opposed to the divergent mode of flow of media leaving the chamber 31 by way of the formations 28, 30 or 58, 60. However, the fuel leaves the chamber in directions opposite in sense to the local motion in the circulation.

As shown, any fuel which leaves the chamber must, as a result, follow paths which turn very sharply around the edge 42 or 72 through angles greater than 90°. In the example each such angle is some 135°.

Air or other atomising fluid may be used in place of steam.

In modifications (not shown), the oil feed passages may be radially outermost instead of innermost as shown in FIG. 2. The oil may be conducted through passages coaxial with the longitudinal axis of the atomiser, the steam being conducted through passages in directions intersecting the directions of flow of the oil.

However, it is preferred to conduct steam through passages surrounding the oil passages because the oil is thus insulated and kept relatively cooler by the steam, which reduces the possibility that the high heat flux impinging on the atomiser from the flame which it emits will cause carbonisation of the oil in the passages.

In another modification, the annular discharge gap is replaced by an outwardly divergent annular array of discharge ports.

What is claimed is:

1. A liquid fuel atomiser comprising:

(a) a body;

(b) a ring-like chamber defined within said body;

(c) exit formations defined by said body for directing media leaving said chamber through said formations into a hollow diverging frusto-conical pattern;

(d) annularly-distributed internal passages defined within said body through which flows of fuel medium and atomising medium pass, the directions of said passages for one medium and the directions of respective passages for the other medium making intersections one with the other whereby media passing through said passages interact one with the other at said intersections; and (e) openings defined within said body by which said media enter said chamber from said passages at positions which are such as to produce rotation of media therein and which are closer than said formations to said intersections.

2. A liquid fuel atomizer comprising:

(a) a body;

(b) an annular chamber defined within said body, said chamber being bounded substantially by opposed surfaces of revolution generated by opposed arcs which have centres of curvature within said chamber, which are disposed generally transversely to the plane of said chamber and which have revolved about the central axis of said chamber;

(c) exit formations defined by said body for directing media leaving said chamber through said formations into a hollow diverging frusto-conical pattern;

(d) annularly-distributed internal passages defined within said body through which flows of fuel medium and atomizing medium pass, the directions of said passages for one medium and the directions of respective passages for the other medium making intersections one with the other whereby media passing through said passages interact one with the other at said intersections; and (e) openings defined with said body by which said media enter said chamber from said passages at positions which are such as to produce rotation of media therein and which are closer than said formations to said intersections.

3. An atomiser according to claim 1, in which said chamber is bounded substantially by opposed surfaces of revolution generated by opposed arcs which have centres of curvature within said chamber, which are disposed generally transversely to the plane of said chamber and which have revolved about the central axis of said chamber.

4. An atomiser according to claim 1, claim 2 or claim 3 in which each of first ones of said passages conducts flows of both media, one flow in the case of each respective first passage being conducted into the first passage by a respective second one of said passages, and in which in each case said intersection between the directions of said passages lies in the respective first passage.

5. An atomiser according to claim 1, claim 2 or claim 3 in which each of first ones of said passages conducts a respective flow of one medium and each of second ones of said passages conducts a respective flow of the other medium and opens partly into said chamber and partly into a respective one of said first passages, and in which said intersection between the directions of said passages lies at the opening of the first passage into said chamber.

6. An atomiser according to claim 1, claim 2 or claim 3 in which each of first ones of said passages conducts a respective flow of one medium and each of second ones of said passages conducts a respective flow of the other medium and said intersections between the directions of said passages lie in said chamber.

7. An atomiser according to claim 3, in which media, subject to said rotation, after passing said positions flow radially inwardly with respect to the central axis of said chamber before reaching said formations.

8. An atomiser according to claim 7, in which after flowing radially inwardly, any media leaving said chamber must turn through more than 90° in order to negotiate said formations.

9. An atomiser according to claim 8, in which media, subject to said rotation, after passing said formations flow in a convergent frusto-conical pattern substantially opposed to said diverging frusto-conical pattern of flow of media leaving said chamber by way of said formations.

10. An atomiser according to claim 1, claim 2 or claim 3, in which the directions of said passages are eccentric to said rotation in said chamber and in which said formations are such that fuel medium leaves said chamber eccentrically to said rotation in said chamber and oppositely to the sense of the local motion in said rotation.

* * * * *